US006092910A

United States Patent [19]

Sung

[11] Patent Number: 6,092,910

[45] Date of Patent: Jul. 25, 2000

[54] FLASHLIGHT

[76] Inventor: Rick Sung, P.O. Box 82-144, Taipei, Taiwan

[21] Appl. No.: 09/301,769

[22] Filed: Apr. 29, 1999

[51] Int. Cl.[7] ..... F21L 7/00

[52] U.S. Cl. ..... 362/206; 362/207; 362/205

[58] Field of Search ..... 362/202, 203, 362/204, 205, 206, 207, 208

[56] References Cited

U.S. PATENT DOCUMENTS

| | | | |
|---|---|---|---|
| 4,949,231 | 8/1990 | Wang | 362/205 |
| 5,006,969 | 4/1991 | Lai | 362/207 |
| 5,550,719 | 8/1996 | Kuo | 362/206 |

*Primary Examiner*—Y. Quach

*Attorney, Agent, or Firm*—A & J

[57] ABSTRACT

A flashlight includes a tubular barrel having an upper end formed with external threads and a lower end firmed with internal threads, a head having a lower end formed with internal threads adapted to engage with the external threads of the tubular barrel, an electrical socket fitted within the upper end of the tubular barrel, a light bulb having two depending electrodes received in the first and second holes of the electrical socket, a reflector arranged on the electrical socket and having a central opening for passage of the light bulb, a piece of glass arranged on the reflector, a tail having an upper end threadedly engage able a lower end of the tubular barrel, a water-proof cap mounted on a lower end of the tail, and a switch arranged within the tail and having a push button fitted in the water-proof cap, whereby the flashlight can be easily operated by depressing the switch at the tail.

1 Claim, 7 Drawing Sheets

FLASHLIGHT

BACKGROUND OF THE INVENTION

1. Field of the Invention

This invention is related to a flashlight and in particular to one which can be easily operated by one hand.

2. Background of the Invention

It has been found that the conventional flashlights on the market suffer from a lot of drawbacks. An example of such a flashlight is described as follows:

Referring to FIGS. 1 and 2, the prior art flashlight includes a tubular barrel 5 with internal threads at one end and external threads 51 at another end. A packing ring 52 is fitted with the end of the tubular barrel 5 with external threads 51. The external threads 51 of the tubular barrel 5 is engaged with internal threads 530 of a head 53. A socket 533 together with a light bulb 532 is fitted in the head 53. Further, above the light bulb, there are mounted a reflector 531, a piece of glass 534 and a packing ring 535. Two batteries 54 are received in the tubular barrel 5. Under the batteries 54 there is a spring 55 and a switch assembly. The switch assembly includes a switch 61, two packing 613, a tail seat 60, a packing ring 59, a washer 58, a hexagonal nut 57 and a screw 56. The switch 61 is provided with a web 610 on which there is a hole 611 for connecting a key ring (not shown). In addition, the switch 61 is formed with a projection 614 having a center threaded hole 615 and two grooves 612 for receiving the two packing 613. The tail seat 60 is provided with external threads 601 and connected with a packing ring 59. Further, the tail seat 60 has a hexagonal recess 602 on which is mounted a washer 58. A hexagonal member 57 is disposed within the hexagonal recess 602 of the tail seat 60. A screw 56 having a stop plate, a first threaded portion 561 and a second threaded portion 562 is threadedly engaged with the hexagonal member 57. Meanwhile, the second threaded portion 562 of the screw 56 will engage with the threaded hole 615 of the switch 61. The threads 601 of the tail seat 60 are engaged with the internal threads 50 of the tubular barrel 5. When the switch 61 is turned in one predetermined direction, the hexagonal member 57 will be forced to go upwards thereby urging the screw 56 to press the spring 55 against the negative pole of the battery 54 and therefore, forming a closed circuit. It should be noted that the screw 56 is connected to the socket 533 by well known means which has no need to be described here in detail. As the switch 61 is turned in a reverse direction, the hexagonal member 57 will be moved downwards thereby detaching the spring from the negative pole of the battery 54 thus breaking off the circuit.

However, such a flashlight is complicated in structure thereby making it difficult to assemble. In addition, it is impossible operate the flashlight with one hand and difficult to maintain. Further, the flashlight is easily damaged by water.

Therefore, it is an object of the present invention to provide an improved flashlight which can obviate and mitigate the above-mentioned drawbacks.

SUMMARY OF THE INVENTION

This invention is related to an improved flashlight.

It is the primary object of the present invention to provide an improved flashlight which can be operated by depressing a switch at the tail end with one hand.

It is another object of the present invention to provide an improved flashlight which is easy to maintain.

It is still another object of the present invention to provide an improved flashlight which is water-proof.

It is still another object of the present invention to provide an improved flashlight which is simple in construction.

It is a further object of the present invention to provide an improved flashlight which is fit for practical The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
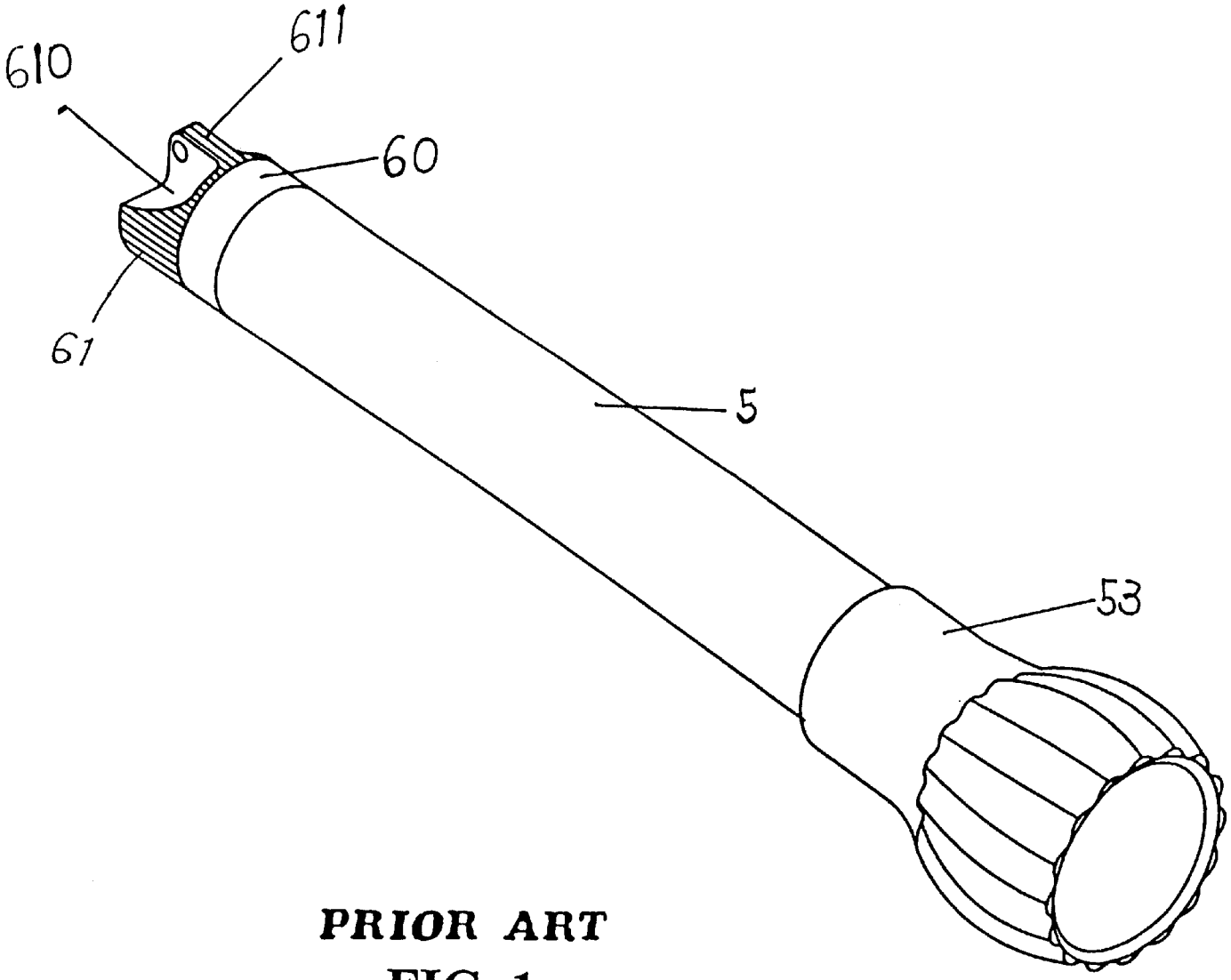
PRIOR ART FIG. 1
FIG. 1 is a perspective view of a prior art flashlight.
Figure 2:
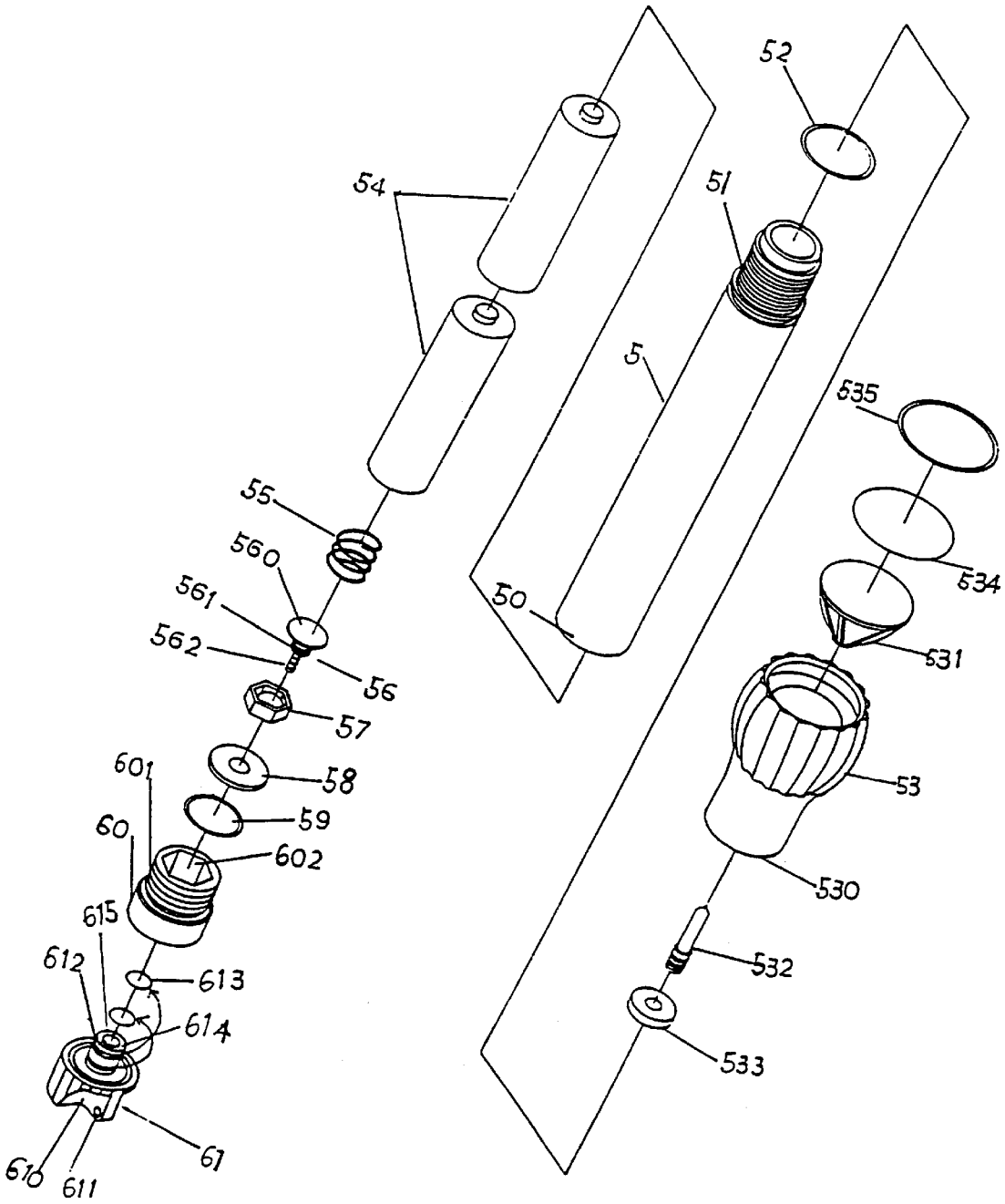
PRIOR ART FIG. 2
FIG. 2 is an exploded view of the prior art flashlight.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
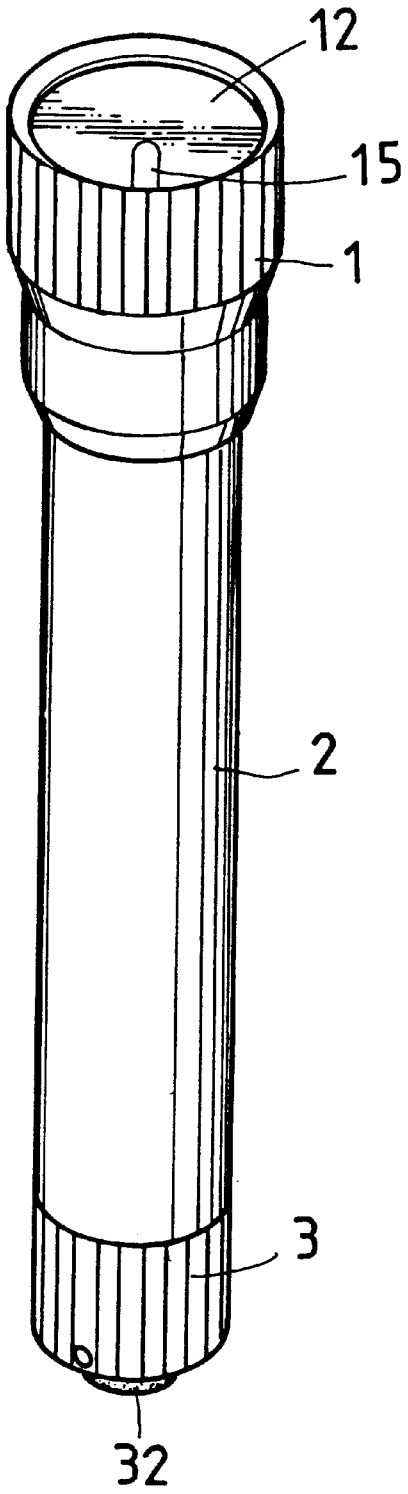
FIG. 3 is a perspective view of a flashlight according to the present invention.
Figure 4:
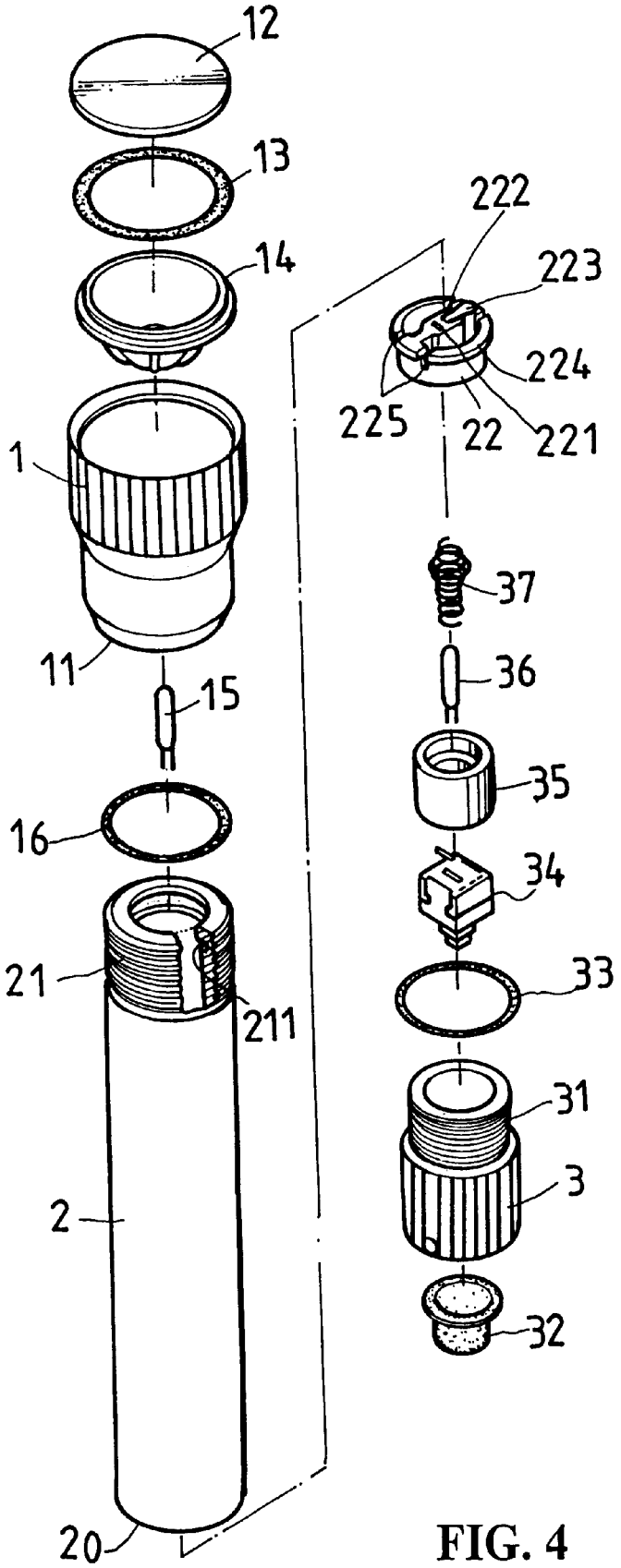
FIG. 4 is an exploded view of the flashlight according to the present invention.
Figure 7:
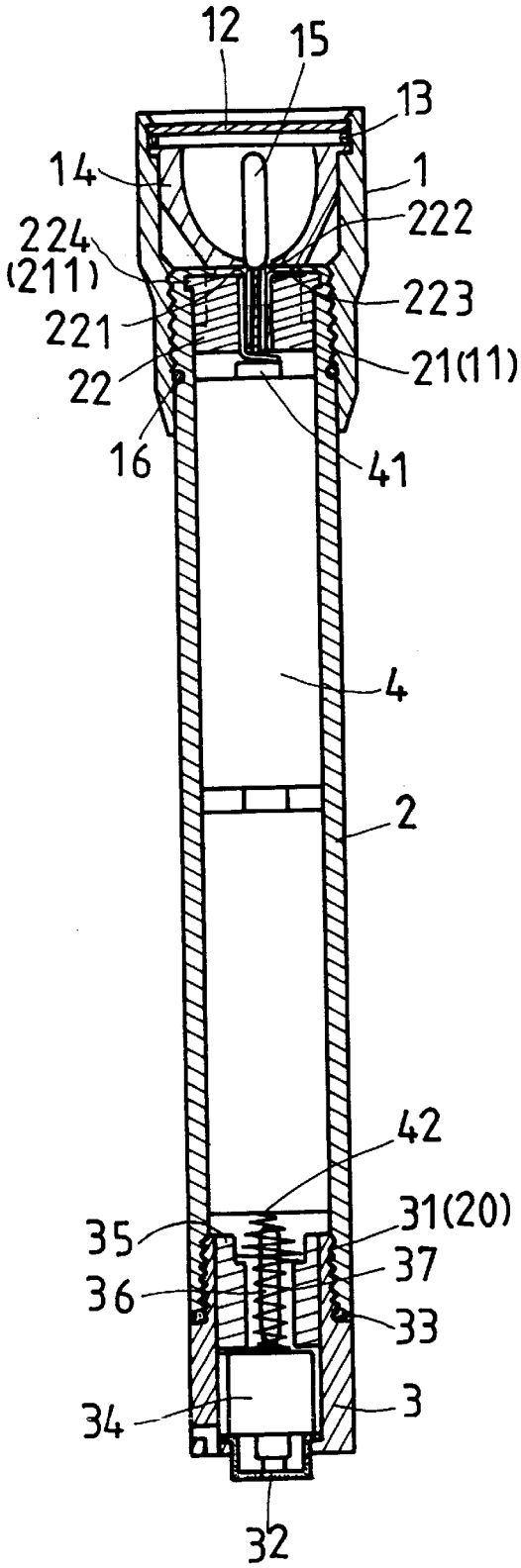
FIG. 7 is a sectional view of the flashlight according to the present invention.

With reference to the drawings and in particular to FIGS. 3, 4 and 7 thereof, the flashlight according to the present invention generally comprises a head 1, a tubular barrel 2, a tail 3.

The tubular barrel 2 is a conductive member formed with external threads 21 at the upper end and internal threads 20 at the lower end.

The head 1 is a cylindrical member formed with internal threads at its lower end adapted to engage with the external threads 21 of the tubular barrel 2.

An electrical socket 22 is fitted within the upper end of the tubular barrel 2. The electrical socket 22 has a first hole fitted with a positive electrode 221 and a second hole fitted with a negative electrode 222. The positive electrode 221 extends downwardly out of the first hole of the electrical socket 22 to the position right under the center of the electrical socket 22, while the negative electrode 22 extends out of the second hole of the electrical socket 22 to contact the inner side of the tubular barrel 2. A light bulb 15 has two depending electrodes received in the first and second holes of the electrical socket 22. The electrical socket 22 is provided at the top with a flange 224 configured to engage with a circular groove 211 at the inner side of the tubular barrel 2 and at the vertical wall with a plurality of notches 225 to provide resiliency for the electrical socket 22.

A reflector 14 is arranged on the electrical socket 22 and has a central opening (shown in FIG. 5 but not numbered) for the passage of the light bulb 15. A piece of glass 12 is arranged on the reflector 14 and fitted into an annular groove of the head 1. A first packing ring 13 is mounted between the reflector 14 and the glass 12. A second packing ring 16 is fitted between the reflector 14 and the upper end of the tubular barrel 2.

Figure 5:
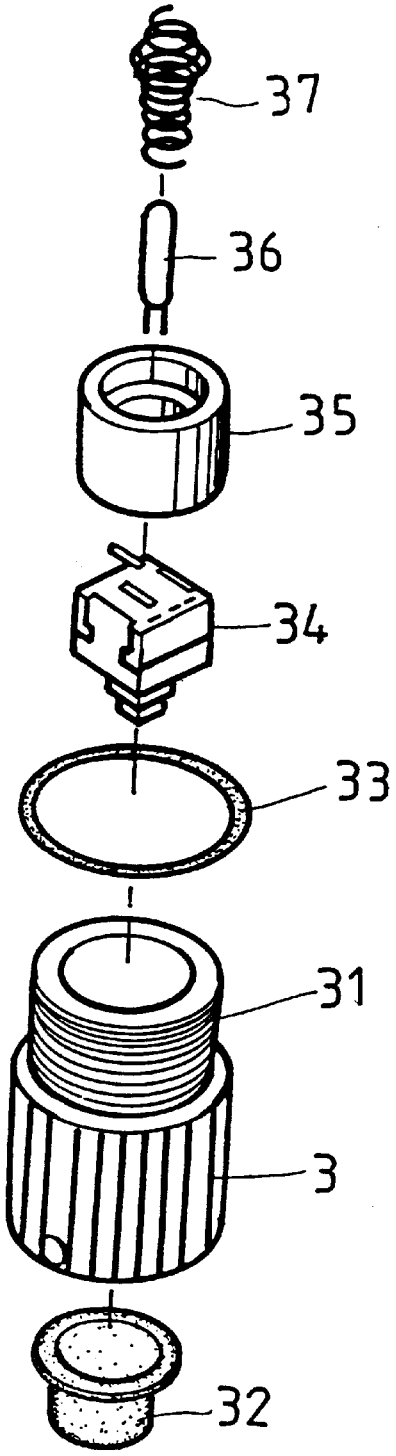
FIG. 5 is an enlarged exploded view of the tail portion.
Figure 6:
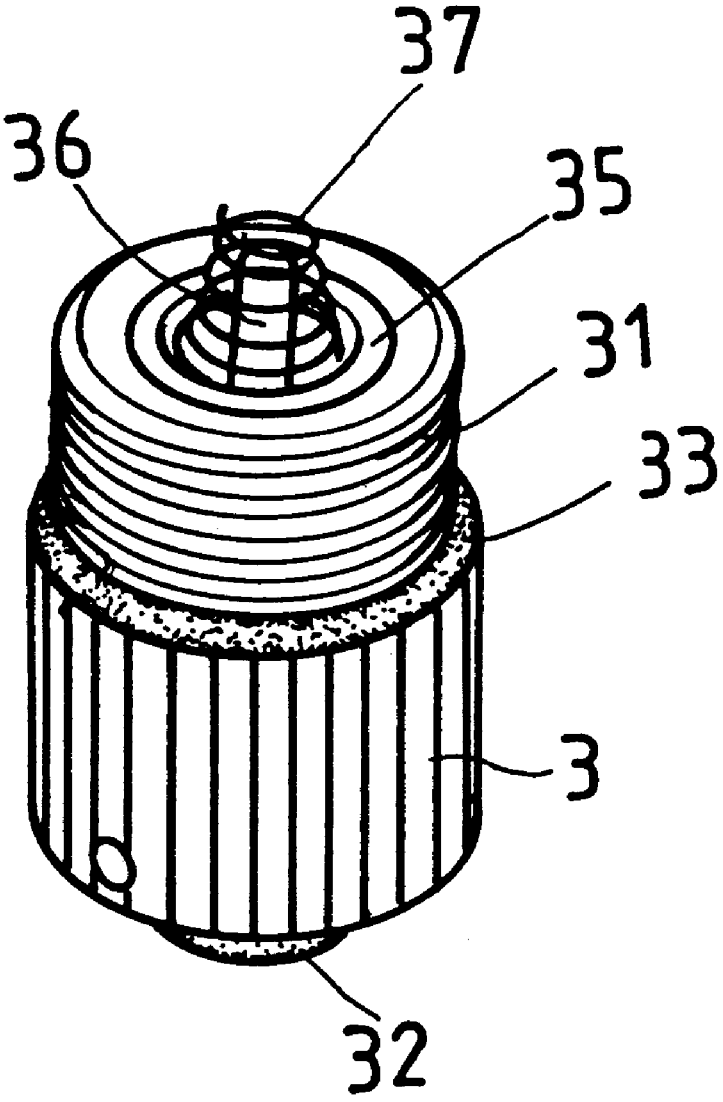
FIG. 6 is an enlarged perspective view of the tail portion.

Referring to FIGS. 3, 4 and 5, the tail 3 is a conductive cylindrical member formed with external threads 31 at the upper end engage able with the internal threads 20 at the lower end of the tubular barrel 2. A third packing ring 33 is fitted between the tail 3 and the tubular barrel 2. The lower end of the tail 3 is provided with a water-proof cap 32 made of flexible material. A push-button type switch 34 is disposed within the tail 3 and has a push button fitted in the water-proof cap 32. An insulating sleeve 35 is snugly-fitted within the tail 3 and located above the switch 34. A spring 37 is put into the insulating sleeve 35 and located on the switch 34. A spare light bulb 36 is inserted into the spring 37. The switch 34 has a first contact connected with a lower end of the spring 37 and a second contact connected with the inner side of the tubular barrel 2. Two batteries 4 are disposed in series within the tubular barrel 2 so that the positive electrode 41 of the battery 4 at the upper position is in contact with the positive electrode 221 of the electrical socket 22 while the negative electrode 42 of the battery 4 at the lower position is in contact with the spring 37 which is connected with the first contact of the switch 34.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A flashlight comprising:

a conductive tubular barrel having an upper end formed with external threads and a lower end formed with internal threads;

a head having a lower end formed with internal threads adapted to engage with said external threads of said tubular barrel;

an electrical socket fitted within said upper end of said tubular barrel, said electrical socket having a first hole fitted with a positive electrode and a second hole fitted with a negative electrode, said negative electrode extending upwardly out of said second hole of said electrical socket to contact an inner side of said tubular barrel, said positive electrode extending downwardly out of said first hole of said electrical socket to a position right under a center of said electrical socket, said electrical socket being provided at a top thereof with a flange configured to engage with a circular groove at said inner side of said tubular barrel and at a vertical wall of said electrical socket with a plurality of notches to provide resiliency for said electrical socket;

a light bulb having two depending electrodes received in said first and second holes of said electrical socket;

a reflector arranged on said electrical socket and having a central opening for passage of said light bulb;

a piece of glass arranged on said reflector and fitted into an annular groove of said head;

a first packing ring mounted between said reflector and said glass;

a second packing ring fitted between said reflector and an upper end of said tubular barrel;

a conductive tail having an upper end threadedly engaged with a lower end of said tubular barrel;

a third packing ring fitted between said tail and said tubular barrel;

a water-proof cap, made of flexible material, mounted on a lower end of said tail;

a switch arranged within said tail and having a push button fitted in said water-proof cap, said switch having an upper end provided with a first contact at a central position of said upper end of said switch and a second contact at one side of said upper end of said switch, said second contact being in contact with an inner side of said tail;

an insulating sleeve snugly-fitted within said tail and located above said switch;

a spring fitted into said insulating sleeve and having a lower end contacting said first contact of said switch;

a spare light bulb inserted into said spring; and two batteries disposed in series within said tubular barrel, with a positive electrode of the battery at an upper position contacting said positive electrode of said electrical socket and a negative electrode of the battery at a lower position contacting said spring.

* * * * *